United States Patent [19]

Yano

[11] Patent Number: 4,630,757

[45] Date of Patent: Dec. 23, 1986

[54] TOY GUN

[76] Inventor: Hiroshi Yano, 2 Jinai-Cho, 1-Chome, Moriguchi-Shi, Osaka, Japan, 570

[21] Appl. No.: 750,998

[22] Filed: Jul. 3, 1985

Related U.S. Application Data

[63] Continuation of Ser. No. 371,492, Apr. 23, 1982, abandoned.

[30] Foreign Application Priority Data

Apr. 25, 1981 [JP] Japan ..... 56-62829

[51] Int. Cl.[4] ..... A63H 3/18

[52] U.S. Cl. ..... 222/79; 222/379; 222/466; 285/184

[58] Field of Search ..... 222/78, 79, 156, 320, 222/370, 386, 372, 380, 383, 388, 384, 465 R, 466, 469, 491, 505, 523; 124/56, 57, 70; 285/184

[56] References Cited

U.S. PATENT DOCUMENTS

| | | | |
|---|---|---|---|
| D. 205,231 | 7/1966 | Blumenthal | D21/146 |
| 1,223,655 | 4/1917 | Arden | 222/79 |
| 1,819,382 | 8/1931 | Palmer | 222/372 X |
| 2,566,487 | 9/1951 | Gora et al. | 222/383 X |
| 2,754,997 | 7/1956 | Hopkins et al. | 222/79 |
| 2,877,931 | 3/1959 | Goldfarb | 222/79 |
| 3,029,539 | 4/1962 | Glass et al. | 42/57 |
| 3,197,070 | 7/1965 | Pearl et al. | 222/79 |
| 3,218,745 | 11/1965 | Golden | D21/146 X |
| 3,334,788 | 8/1967 | Hamilton | 222/143 |

FOREIGN PATENT DOCUMENTS

| | | | |
|---|---|---|---|
| 341219 | 3/1918 | Fed. Rep. of Germany | 222/79 |

*Primary Examiner*—Joseph J. Rolla
*Assistant Examiner*—Michael S. Huppert
*Attorney, Agent, or Firm*—Wenderoth, Lind & Ponack

[57] ABSTRACT

A toy gun for projecting a fluent material. The gun has a front gun body and a hollow rear gun body, one having a cylinder as a part thereof and the other having a piston as a part thereof, the piston being slidable in the cylinder for a distance greater than the finger barrel of a user.

A handle is provided on each of the gun bodies projecting laterally thereof for gripping the bodies for relatively moving them for moving the piston back and forth in the cylinder. A nozzle is provided on the piston or cylinder on the front gun body.

Guides on one of the gun bodies engage with a stop on the other of the gun bodies for guiding the gun bodies in the direction of the axes of the piston and cylinder. The guides having cut away portions at the end remote from the end of the gun body relative to which the other gun body is in sliding engagement for permitting rotation of the gun bodies around the axis of the piston and cylinder, whereby the handles can be aligned or can be oriented at an angle to each other around the axes of the piston and cylinder.

5 Claims, 8 Drawing Figures

TOY GUN

This application is a continuation of now abandoned application Ser. No. 371,492 filed Apr. 23, 1982.

FIELD OF THE INVENTION

The present invention relates to an improved projectile discharging toy gun, and more particularly to a toy gun for discharging a massive quantity of water, air, balls, or other projectile by the movement of the both hands which hold grips on the gun body, and whereby the duration of the projectile discharging operation of the gun body can be freely controlled so as to be long or short as desired.

DESCRIPTION OF THE PRIOR ART

There are prior art rifle-style toy water guns. Most of them, however, have a projectile discharging cylinder near the center of the gun body and the front portion of the piston device extends forwardly therefrom. A cylindrical lateral bar on the forwardly extending part of the piston is provided for holding the front part of the gun body with one hand as well as for sliding the piston in the direction of the length of the barrel for carrying out a discharging operation.

Further, in such rifle-sytle toy water guns the discharging cylinder is fixed at the center of the gun body, and the nozzle is not provided directly on the discharging cylinder or the piston device. Rather the projectile is fed through a long, narrow pipe extending from the discharging cylinder to the front portion of the gun and the projectile is discharged from the nozzle which is at the front end of the gun.

SUMMARY OF THE INVENTION

The main object of the present invention is to provide a projectile discharging toy gun with which even a young infant of two years old or so can play.

Another object of the invention is to provide a toy gun capable of discharging an amount of projectiles ranging from a maximum to a minimum per unit time.

A further object of the invention is to provide a toy gun which can project projectiles over a long distance by minimizing the loss of the pressure used for discharge by placing the cylinder and piston at the front end of the projectile discharging toy gun.

A still further object of the invention is to provide a projectile discharging toy gun which enables the user to enjoy various ways of discharging projectiles by sliding the gun body back and forth freely or rotating it around the barrel.

With the above objects in view as may hereafter more fully appear from a study of the following specification and the appexed drawings, the invention consists of the novel constructions and combination of elements defining the toy gun, but it is to be understood that changes and modifications may be resorted to coming with the purview of the claims without departing from the spirit and nature of the invention.

DETAILED DESCRIPTION OF THE INVENTION

Figure 1:
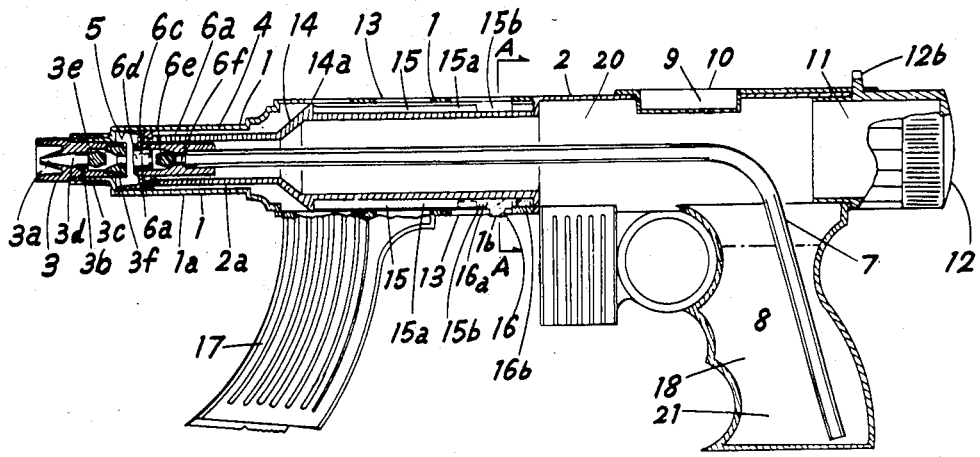
FIG. 1 is a sectional side view of a toy gun according to the invention.

In the prior art toy guns, generally speaking, it has been a common practice to provide means which move through a stroke for projecting fluent material which can be operated by a single finger pulling a trigger. The trigger is normally movable through the same stroke as the means for projecting the fluent material, and because the finger and the trigger can move through a relatively short stroke, the stroke of the means for projecting the fluent material has been relatively short.

The present invention has provided a structure by which the length of stroke of the means for propelling the fluent material is independent of any stroke of a trigger.

Turning to the drawings, the toy gun of the present invention has a gun body divided into two parts, a front gun body 1 and a rear gun body 2. The front gun body has a gun barrel 1*a* with a cylinder means 4 extending rearwardly from the front end thereof, and a guide means 1*c* in the form of a cylindrical chamber extending rearwardly from the cylinder means 4. The rear gun body has mounted thereon a piston means in the form of a piston 5 which is slidable in the cylinder means 4, so that the rear gun body and front gun body are relatively slidable back and forth in the direction of the movement of the piston 5 within the cylinder means 4.

A nozzle means 3 including a one-way or check valve means is provided on the front end of the front gun body 1, and has a nozzle member 3*a* opening out of the front thereof, to which a bore 3*d* extends from within the nozzle. The bore 3*d* has a front valve stop 3*b* therein, with a projection 3*c* extending rearwardly therefrom into a hollow chamber 3*g* within the nozzle means. The hollow chamber 3*g* opens rearwardly of the nozzle through an opening 3*f*, and within the chamber is a check valve body 3*e*, which, when in the forward position seats on the projection 3*c* to leave a passage thereby for the flow of the fluent material through the nozzle, and in the rearward position seats in a valve seat around the opening 3*f* for blocking flow of air rearwardly into the cylinder means 4. The piston 5 is mounted on the rear gun body 2 on the forward end of a barrel 2*a*, which is joined to a guide portion 15 by a generally conical gun body forward movement stop 14. At the forward end of the barrel portion 2*a* is a one-way or check valve means in the form of a check valve 6 which has a body member 6*a* with a forwardly extending opening 6*d* therein, a projection 6*c* extending rearwardly therefrom into a space 6*g* within the check valve 6, a rearwardly extending opening 6*f*, and a valve member 6*e* within the space 6*g* within the valve. In the rearward position, as shown in the drawing, the valve member 6*e* seats in a seat around the opening 6*f* to prevent rearward flow of fluent material as the piston moves forwardly, and in the forward position, it engages the projection, so as to leave a space through which the fluent material can flow through the opening 6d.

Inserted into a recess in the rear of the body 6a of the check valve 6 is a fluent material tube 7 which extends rearwardly through the rear gun body 2 into a storage space 8, for example in a handle 18 on the lower portion of the rear gun body 2.

Figure 2:
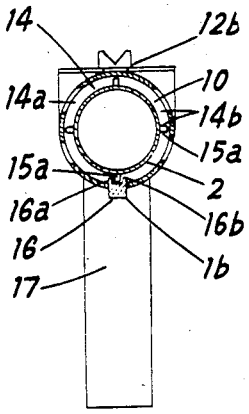
FIG. 2 is a sectional view taken along line A—A of FIG. 1.
Figure 6:
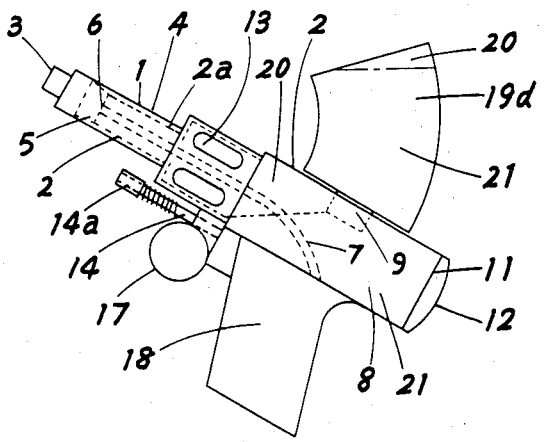
FIG. 6 is a schematic side view of a toy gun of FIG. 8 in a position for discharging obliquely upward.
Figure 7:
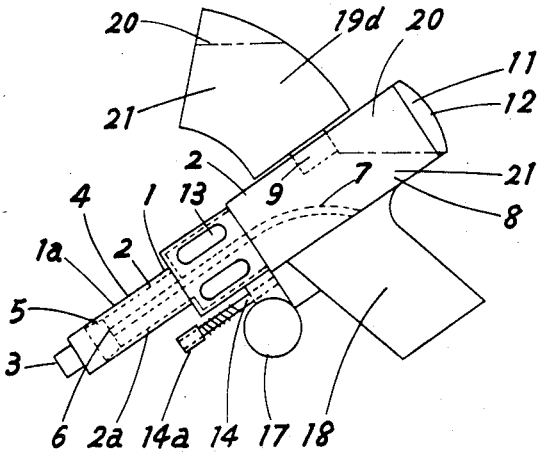
FIG. 7 is a schematic side view of a toy gun of FIG. 8 in a position for discharging obliquely downward.
Figure 8:
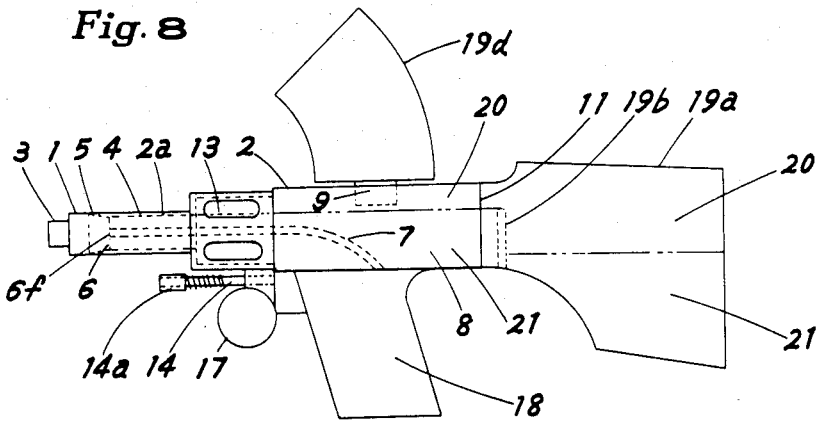
FIG. 8 is a schematic sectional side view of another embodiment of a toy gun according to the invention.

Openings 13 are provided in the wall of the guide means 1c around the rearwardly extending cylindrical guide portion 15, and the rear gun body has a forwardly facing surface 2b against which the rear end of guide means 1c abuts in the rearward most position of front gun body 2 on the rear gun body 2, as shown in FIG. 1. To the rear of the surface 2b is an upper opening 9 in the rear gun body 2 which is normally closed by a lid 10. The lid 10 can be replaced by a magazine-shaped fluent material storage chamber 19, as shown in FIG. 2, or 19d as shown in FIGS. 6–8, which can hold additional fluent material. The rear opening 11 of the rear gun body is closed by a lid 12 which has a gun sight 12b thereon.

The guide portion 15 has ribs 15a extending longitudinally thereof and spaced at intervals around the circumference thereof, and which slidably engage the guide surface of the guide means 1c, and these ribs 15a terminate short of the rear end of the guide portion 15 to leave a gap 15b. At the rear end of the barrel 1a of the front gun body 1 is a stop 1b which projects into the gun barrel, and has forwardly and rearwardly extending leg portions 16a and 16b of about the same length as the gap 15b. The total length of the leg portions and the stop is slightly greater than the length of the gap 15b. Depending from the barrel of the front gun body is a front gun body handle 17.

It will thus be seen that the front and rear gun bodies are slidable relative to each other in the direction toward and away from each other, the piston 5 sliding in the cylinder means 4, and in its rearward movement closing the front check valve and allowing the rear check valve to open, thus drawing fluent material through the supply pipe 7 past the rear check valve into the space within the cylindrical means 4 ahead of the piston 5. When the parts are moved relatively toward each other, the piston 5 slides relatively forwardly in the cylinder means 4, and the rear check valve closes, the valve body 6e seating on the valve seat around the opening 6a, and the forward check valve opens, the valve body 3e seating on the projection 3c, so that fluent material in the cylinder means 4 is projected forwardly through the front check valve to be projected from the nozzle 3. The length of the stroke is limited only by the length of the cylindrical means and the stroke of the piston therein. This is independent of the movement of a finger of the user.

The parts are moved relative to each other by the user gripping the handle 18 in one hand and the handle 17 in the other hand, and moving the hands toward or away from each other. Because the stroke can be made long, the length of the cylinder portion can be made about 100 to 200 mm, so that the fluent material 21 from the storage space 8, such as water, can be projected great distances by rapid movement of the gun bodies 1 and 2 toward each other through the full stroke.

It will be seen that because the handle 17 is on the outside of the barrel of the front gun body, the piston 5 and the cylindrical means 4 and the guide portion 15 on which it is mounted can be moved freely into the front gun body without interference from the handle 17. Thus the range of the movement of the piston within the cylinder means can be rather great, and the actual stroke can be freely chosen by the operator to be the full length of the relative movement or anything less.

The forward movement stop 14 is a conical portion joining the forward end of the rear gun body and the guide portion 15 projects slightly radially outwardly to the guide portion 15 to form a stop member 14a, which, when the forward gun body is moved to the full forward extent, is engaged by the stop 1b for blocking further forward movement. The stop member 14a has a cut 14b therein (see FIG. 3) preferably at the top part thereof, through which the stop 1b can be passed when the front body portion is moved onto the rear body portion during assembly of the toy gun. Only deliberate manipulation by relative rotation of the front and rear gun body parts and then relative movement away from each other with the parts in the proper relatively rotated position can cause the front gun body to be moved off the rear gun body. The cut 14b can be slanted relative to the longitudinal axis of the gun bodies. Thus, small children can play with the gun, and not unintentially cause the front and rear gun bodies to separate.

The provision of the gaps 15b at the rear ends of the rigs 15a permits the front and rear gun bodies 1 and 2 to be rotated relative to each other when the rear gun body is inserted fully into the front gun body, so that the stop 1b is circumferentially aligned with the gaps 15b. Thus, the person playing with the gun can hold the handle 17 and handle 18 aligned, or can have them circumferentially offset. The stop member 1b has a groove in the upper surface thereof, in which a rib 15a can engage for causing the front and rear gun bodies to move linearly toward and away from each other, as shown in FIG. 2. It will be understood, however, that the stop member 1b can also be caused to move into the circumferential space between the ribs, and the gun bodies can still be moved toward and away from each other, and also rotated relative to each other at the same time.

Figure 3:
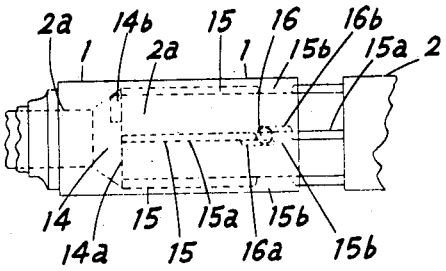
FIG. 3 is a partial bottom view of the toy gun of FIG. 1 with the grip 17 removed.

The stop 1b can have a mounting guide device 16 thereon with the legs 16a and 16b extending relatively forwardly and rearwardly from the inner end of the stop body and spaced circumferentially on opposite sides of a gap corresponding to the width of a rib 15a, as shown in FIGS. 2 and 3. This makes it possible to relatively slide the parts smoothly through the gap 15b. In this case, the member 16 serves as the front gun body stop when it abuts the stop member 14a.

It will be seen that the handle 17 is shaped similar to a magazine, for simulating the appearance of a real gun.

The provision of the openings 13 in the cylindrical body 1 makes it possible to observe the relative movement of the gun bodies.

As can be seen from FIGS. 6–8, the hole 9 in the rear of the rear gun body 2, which is normally closed by the lid 10, can be used to attach a further magazine 19d, which can have the shape of a real magazine, and can be used to store additional fluent material 21. In addition, or alternatively, the rear closure 12 for the rear opening 11 can be removed, and replaced with a gun-butt-shaped member 19a which can store still further fluent material 21. The supply pipe 7 can be caused to terminate in the rear cylindrical portion of the rear gun body 2, rather than extend down into the handle 18, and the handle 18 can be closed off, so that the fluent material is contained only in the magazine 19d, and/or the gun-butt-shaped container 19a. The gun can then be held in various positions, such as shown in FIGS. 6 and 7, and the fluent material projected therefrom regarless of the angle of inclination of the gun.

A barrier 19b can be provided between the gun-butt-shaped container 19a and the remainder of the interior of the rear gun body, so as to control the flow of fluent material from the container 19a into the rear gun body 2.

Figure 4:
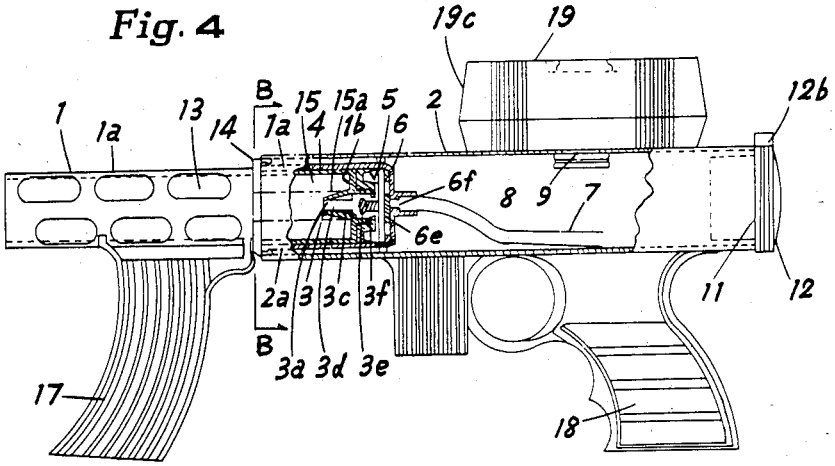
FIG. 4 is a sectional side view of a modified embodiment of a toy gun according to the invention.
Figure 5:
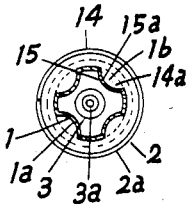
FIG. 5 is a sectional view taken along line B—B of FIG. 4.

The embodiment of FIGS. 4 and 5 is generally the reverse of the embodiment of FIGS. 1–3, i.e. the cylinder means 4 is mounted on the inside of the front end of the rear gun body 2, and the front gun body 1 has the piston 5 thereon slidable in the cylinder means 4 of the rear gun body. The nozzle 3 is immediately in front of the piston 5, and the piston 5 has an aperture therethrough in which the nozzle 3 is incorporated. The rear one-way or check valve 6 is a simple valve plate which covers and uncovers the opening 6f in the rear end of the cylinder means 4. The stop 14 is mounted on the front of the rear gun body and is engaged by a stop 1b constituted by the forward face of the piston 5. The piston 5 and the front gun body 1 are generally cruciform in shape, and the barrel portion 1a is cylindrical and is around the main part of the gun body and has the openings 13 therein.

I claim:

1. A toy gun for projecting a fluent material, comprising:

a front gun body and a hollow rear gun body, one having a cylinder means as a part thereof and the other having a piston means as a part thereof, said piston means being slidable in said cylinder means for a distance greater than the finger travel of a user;

spaced-apart handle means on the respective gun bodies projecting laterally thereof for gripping said bodies for relatively moving them for moving said piston means back and forth in said cylinder means;

a nozzle means on said piston or cylinder means on said front gun body;

a first one way valve means connected to said nozzle means for closing when said gun bodies are moved relative to each other for moving the piston means out of the cylinder means;

a second one way valve means on said piston or cylinder means on said rear gun body for closing when said gun bodies are moved relative to each other for moving said piston means into said cylinder means;

fluent material conduit means connected to said second one way valve means from within said rear gun body; and a stop member on one of said gun bodies extending around the circumference of said one gun body, and a further stop member on the other of said gun bodies, said first mentioned stop member having a cut-out portion in the periphery thereof through which said further stop means can pass when the gun bodies are being assembled.

2. A toy gun as claimed in claim 1 in which said cut-out portion is slanted relative to the longitudinal axis of said gun bodies.

3. A toy gun for projecting a fluent material comprising:

a front gun body and a hollow rear gun body, one having a cylinder means as a part thereof and the other having a piston means as a part thereof, said piston means being slidable in said cylinder means for a distance greater than the finger travel of a user;

spaced-apart handle means on the respective gun bodies projecting laterally thereof for gripping said bodies for relatively moving them for moving said piston means back and forth in said cylinder means;

a nozzle means on said piston or cylinder means on said front gun body;

a first one way valve means connected to said nozzle means for closing when said gun bodies are moved relative to each other for moving the piston means out of the cylinder means;

a second one way valve means on said piston or cylinder means on said rear gun body for closing when said gun bodies are moved relative to each otehr for moving said piston means into said cylinder means;

fluent material conduit means connected to said second one way valve means from within said rear gun body; and guide means on one of said gun bodies engaged with stop means on the other of said gun bodies for guiding said gun bodies in the direction of the axes of said piston and cylinder means, said guide means having cut away portions at the end remote from the end of the gun body relative to which the other gun body is in sliding engagement to define a gap for permitting passage of said stop means to permit rotation of said gun bodies around the axis of said piston and cylinder means, whereby said handle means can aligned or can be oriented at an angle to each other around the axes of said piston and cylinder means.

4. A toy gun as claimed in claim 3 in which said stop means has a mounting guide means having legs extending forwardly and rearwardly from the stop means, the legs being spaced circumferentially of the gun bodies and being about the same length as the dimension of said gap along said gun bodies.

5. A toy gun for projecting a fluent material, comprising:

a gun body divided into a front body part and a rear body part which are mutually engaged and are longitudinally slidable relative to one another; said front body part having a cylinder barrel at the front portion thereof and a tubular rear portion open to the rear, the cylinder barrel having a diameter smaller than the diameter of said tubular rear portion and having a discharge nozzle at the front end thereof; said rear body part having a front piston barrel and a tubular rear portion, the front piston barrel having a smaller diameter than the tubular rear portion of the rear body part, and having a piston at the front end thereof, said piston being slidable in a piston-cylinder relationship in said cylinder barrel, the interior of said cylinder barrel constituting a cylinder chamber in which said piston slides during relative movement of said gun body parts for generating an elevated pressure in said cylinder chamber for discharging fluent material through said nozzle;

one of said tubular rear portions having a guide means therearound engageable with the other tubular rear portion for guiding said body parts in relative sliding movement, and the other of said tubular rear portions having a stop thereon engageable with said guide means when said body parts are moved to the position farthest apart for preventing said tubular rear portion on said rear body part from coming out of the open rear end of the tubular rear portion on the front body part; said rear body part having means for storing material therein; and means for transferring the fluent material from said rear body part into said cylinder barrel.

* * * * *